US009088113B2

(12) United States Patent
Funayama et al.

(10) Patent No.: US 9,088,113 B2
(45) Date of Patent: Jul. 21, 2015

(54) CONNECTOR

(71) Applicant: IRISO ELECTRONICS CO., LTD., Kanagawa (JP)

(72) Inventors: Daisuke Funayama, Kanagawa (JP); Shigeru Mitsuzuka, Kanagawa (JP); Tomisaburo Yamaguchi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/475,972

(22) Filed: Sep. 3, 2014

(65) Prior Publication Data

US 2015/0064975 A1 Mar. 5, 2015

(30) Foreign Application Priority Data

Sep. 5, 2013 (JP) ..... 2013-184389
Nov. 25, 2013 (JP) ..... 2013-243072

(51) Int. Cl.
*H01R 13/64* (2006.01)
*H01R 12/71* (2011.01)
*H01R 13/20* (2006.01)

(52) U.S. Cl.
CPC ..... *H01R 12/716* (2013.01); *H01R 13/20* (2013.01)

(58) Field of Classification Search
CPC ..... H01R 13/6315
USPC ..... 439/248, 247
See application file for complete search history.

(56) References Cited

U.S. PATENT DOCUMENTS

| | | | | |
|---|---|---|---|---|
| 4,106,841 | A | 8/1978 | Vladic | |
| 5,556,286 | A * | 9/1996 | Ikesugi et al. | 439/74 |
| 6,155,858 | A * | 12/2000 | Ozawa et al. | 439/248 |
| 2012/0142226 | A1 * | 6/2012 | Funayama et al. | 439/692 |
| 2014/0099828 | A1 | 4/2014 | Takane et al. | |
| 2015/0024620 | A1 * | 1/2015 | Kobayashi et al. | 439/345 |

FOREIGN PATENT DOCUMENTS

| | | | |
|---|---|---|---|
| JP | 10-055856 | A | 2/1998 |
| JP | 3117439 | B1 | 10/2000 |
| JP | 2007-018785 | A | 1/2007 |
| JP | 2011-159570 | A | 8/2011 |
| KR | 10-2012-0027020 | | 3/2012 |
| KR | 10-2013-0055653 | | 5/2013 |

OTHER PUBLICATIONS

Office Action from Korean Patent App. No. 10-2014-0115935 (Oct. 7, 2014).
European Search Report for European Patent App. No. 14183187.5 (Dec. 2, 2014).

* cited by examiner

*Primary Examiner* — Phuong Dinh
(74) *Attorney, Agent, or Firm* — Cermak Nakajima & McGowan LLP; Tomoko Nakajima

(57) ABSTRACT

A second elastic portion includes a bent section connected via the proximal end portion to a first fixing portion formed so as to circumvent along a shape of a distal end portion and a part of a lateral face of a projecting portion of a first movable housing.

2 Claims, 9 Drawing Sheets

CONNECTOR

BACKGROUND OF THE INVENTION

1. Field of the Invention

The present invention relates to a connector used for connecting, for example, a pair of printed substrates to each other.

2. Description of the Related Art

Connector units are thus far known that include a first connector attached to one of a pair of substrates disposed such that respective surfaces oppose each other, and a second connector attached to the other substrate, the first connector and the second connector being configured to be fitted together to connect the substrates, for example as disclosed in Japanese Unexamined Patent Application Publication No. 2007-18785.

One of the connectors includes a fixed housing to be fixed to the substrate, a movable housing disposed to move relative to the fixed housing in a front-back direction and a width direction of the connector, and a plurality of terminals each having an end portion retained by the movable housing and the other end portion retained by the fixed housing. The movable housing is displaced relative to the fixed housing by elastic deformation of a movable portion provided between the end portions of each of the terminals, so as to absorb a positional shift between the substrates arising from vibration or impact.

Now, some socket connectors, corresponding to the first connector, include a first and a second contact portion terminal, which are elastically deformable, disposed so as to make contact with a contact portion of a terminal of a plug connector, corresponding to the second connector, the first and the second contact portion being located with a spacing therebetween in the direction in which the connectors are fitted together. With the mentioned configuration, even though a foreign matter such as dust or stain is stuck to the terminal of the plug connector, the second contact portion can make contact therewith after the foreign matter is removed by the first contact portion, which assures the electrical conduction between the terminal of the plug connector and the terminal of the socket connector.

To be more detailed, the terminal of the socket connector includes the first contact portion and the second contact portion, a first elastic portion and a second elastic portion elastically deformable in the direction to contact the terminal of the plug connector, a first fixing portion fixed to the movable housing, a movable portion elastically deformable in a width direction of the connector, a second fixing portion fixed to the fixed housing, and substrate connection portion to be connected to the substrate.

The first elastic portion extends upward from the upper end portion of the first fixing portion, and the first contact portion is provided on the upper end portion of the first elastic portion.

The second elastic portion extends upward from the upper end portion of the first fixing portion, and the second contact portion is provided on the upper end portion of the second elastic portion. The first and the second elastic portion are located with a spacing therebetween in a front-back direction, the second elastic portion being located closer to the center of the connector in the front-back direction.

Here, in the case where the second elastic portion of the socket connector is formed in a linear shape, the proximal end portion connected to the first fixing portion has to be shifted forward or backward in the front-back direction of the connector in order to avoid interference with a projecting portion of the first movable housing supporting the terminal of the plug connector, and hence the width of the second movable housing in the front-back direction has to be increased. Therefore, not only the socket connector but also the plug connector have to be made larger in the front-back direction.

The present invention has been accomplished in view of the foregoing drawback, and provides a connector that suppresses an increase in size in the front-back direction, despite including a multi-contact terminal having a plurality of contact portions and elastic portions.

SUMMARY OF THE INVENTION

In an aspect, the present invention provides a connector including a housing, and a terminal including a first contact portion and a second contact portion to be brought into contact with a mating terminal of a mating connector, a first elastic portion and a second elastic portion elastically deformable in a direction to contact the mating terminal, and a first fixing portion fixed to the movable housing. The movable housing includes a central partition wall formed at a central portion of the connector in a front-back direction and extending in the direction to contact the mating terminal, so as to oppose a projecting portion of a housing of the mating connector and to retain the mating terminal when the connectors are fitted together. The terminal is disposed such that the first fixing portion contacts the central partition wall, the first and the second elastic portion are formed so as to extend upward from an upper end portion of the first fixing portion and spaced from each other in the front-back direction with the second elastic portion located closer to the central portion in the front-back direction than the first elastic portion, and the second elastic portion includes a bent section formed close to a proximal end portion connected to the first fixing portion, so as to circumvent along a shape of a distal end portion and a part of a lateral portion of the projecting portion of the mating connector.

In the case where the second elastic portion is formed in a linear shape, the proximal end portion connected to the first fixing portion has to be shifted away from the central partition wall in order to avoid interference with the projecting portion, and hence the width of the movable housing in the front-back direction has to be increased. Therefore, not only the connector of the present invention but also the mating connector have to be made larger in the front-back direction.

In contrast, the second elastic portion including the bent section allows the interference to be avoided thereby enabling reduction in size of the connectors. In addition, the bent section serves to increase the spring length of the second elastic portion, thereby preventing degradation in insertion and removal performance and in spring elasticity, and decline in connection reliability of the connectors.

With the mentioned configuration, further, even though a foreign matter such as dust or stain is stuck to the contact portion of the terminal of the mating connector, the second contact portion can make contact therewith after the foreign matter is removed by the first contact portion, which assures the electrical conduction with the mating connector.

The bent section is connected via the proximal end portion to the first fixing portion at the position where the bent section contacts the central partition wall, and is bent away from the central partition wall and then curved toward the central portion in the front-back direction.

The mentioned configuration allows the interference to be avoided, thereby enabling reduction in size of the connector. In addition, the bent section serves to increase the spring length of the second elastic portion, thereby preventing degradation in insertion and removal performance and in spring elasticity, and decline in connection reliability of the connectors.

The foregoing connectors may be configured as a connector unit including a first connector attached to one substrate and a second connector attached to another substrate, the first connector and the second connector being configured to be fitted together to connect the substrates. The first connector includes a first fixed housing to be fixed to the one substrate, a first movable housing disposed so as to move relative to the first fixed housing, and a first terminal having one end portion retained by the first movable housing and the other end portion retained by the first fixed housing. The first terminal includes a movable portion elastically deformable in a front-back direction of the connector, and the movable portion has a width taken in a width direction of the connector larger than a thickness taken in the front-back direction or an up-down direction of the connector. The second connector includes a second fixed housing to be fixed to the another substrate, a second movable housing disposed so as to move relative to the second fixed housing, and a second terminal having one end portion retained by the second movable housing and the other end portion retained by the second fixed housing. The second terminal includes a movable portion elastically deformable in the width direction of the connector, and the movable portion has a thickness taken in the front-back direction or up-down direction of the connector larger than a width taken in the width direction of the connector.

In the connector unit configured as above, the movable portion of the first terminal of the first connector can easily be elastically deformed in the front-back direction or up-down direction of the connector, since the movable portion is larger in the width direction than in the thickness direction. Likewise, the movable portion of the second terminal of the second connector can easily be elastically deformed in the width direction of the connector, since the movable portion is larger in the thickness direction than in the width direction. Therefore, when the positional shift between the substrates takes place in the front-back direction of the connector the movable portion of the first terminal is elastically deformed, and when the positional shift between the substrates takes place in the width direction of the connector the movable portion of the second terminal is elastically deformed.

Forming thus the movable portion of the first terminal of the first connector to be larger in the width direction than in the thickness direction, so as to be elastically deformed in the front-back direction of the connector, and the movable portion of the second terminal of the second connector to be larger in the thickness direction than in the width direction, so as to be elastically deformed in the width direction of the connector, allows the respective movable portions of the first and second terminals to be formed with an increased cross-sectional area, thereby enabling the allowable current of the terminal to be increased, unlike a configuration in which the movable portion is elastically deformable to a sufficient extent both in the front-back direction and in the width direction of the connector.

One of the foregoing connectors may be configured as a connector attached to one substrate and configured to be fitted to another connector attached to another substrate so as to connect the substrates. The connector includes a fixed housing to be fixed to the one substrate, a movable housing disposed so as to move relative to the fixed housing, and a terminal having one end portion retained by the movable housing and the other end portion retained by the fixed housing. The terminal includes a first and a second contact portion to be brought into contact with a terminal of the another connector, with a spacing between the first and the second contact portion in the direction in which the connectors are fitted together, and a movable portion elastically deformable in the width direction of the connector, and the movable portion has a thickness taken in the front-back direction or up-down direction of the connector larger than a width taken in the width direction of the connector.

The movable portion of the terminal configured as above has a thickness taken in the front-back direction or up-down direction of the connector larger than a width taken in the width direction of the connector, and is hence easy to elastically deform in the width direction of the connector. Accordingly, the cross-sectional area of the movable portion can be increased, so that the allowable current of the terminal can be increased.

In addition, the terminal includes the first and second contact portions to be brought into contact with the terminal of the other connector, with a spacing defined between the first and the second contact portion in the direction in which the connectors are fitted together. With the mentioned configuration, when the connector is fitted to the other connector the second contact portion can make contact with the terminal of the other connector following up the sliding track of the first contact portion marked thereon, and therefore even though a foreign matter is stuck to the terminal of the other connector, the second contact portion can make contact therewith after the foreign matter is removed by the first contact portion, which leads to upgraded connection reliability of the connectors.

Further, the terminal contacts the mating terminal via the first and second contact portions, and hence exerts a larger contact force on the mating terminal to firmly hold the same, compared with the case of contacting via a single contact portion. Therefore, even though the connectors are subjected to vibration during the practical use, the first and second contact portions can be prevented from micro-sliding relative to the mating terminal and from thus scraping off the plating and increasing the contact resistance. In this aspect also, the connection reliability of the connectors can be upgraded.

The connectors configured as above can suppress an increase in size in the front-back direction, despite including a multi-contact terminal having a plurality of contact portions and elastic portions.

DESCRIPTION OF THE PREFERRED EMBODIMENTS

Figure 1:
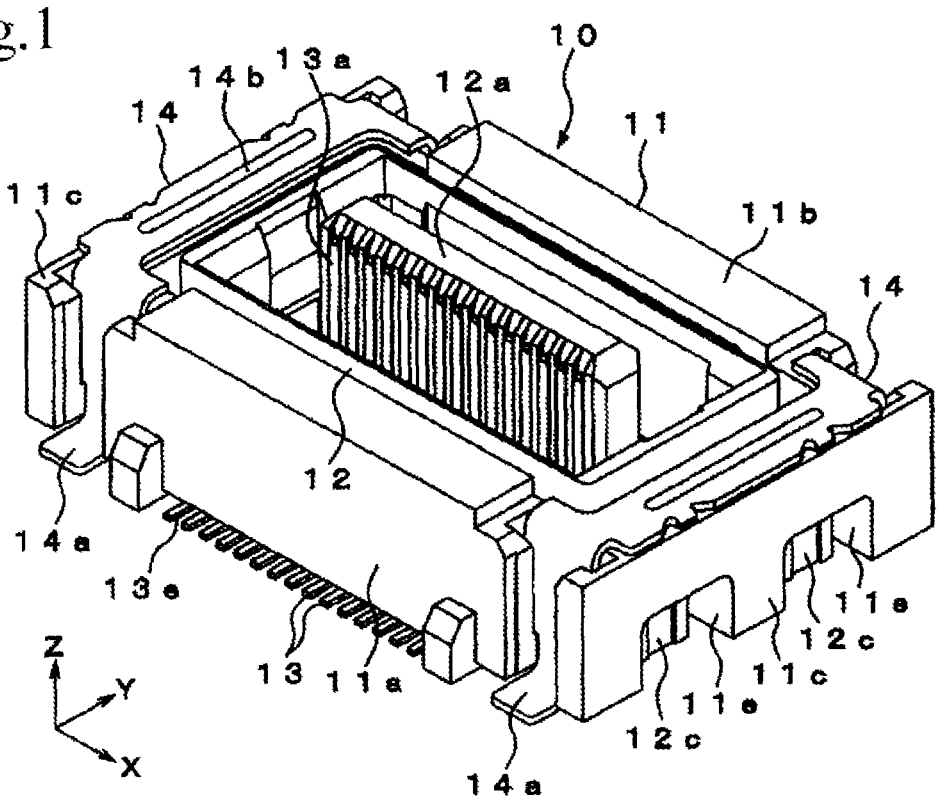
FIG. 1 is a perspective view showing a first connector according to an embodiment of the present invention.
Figure 2:
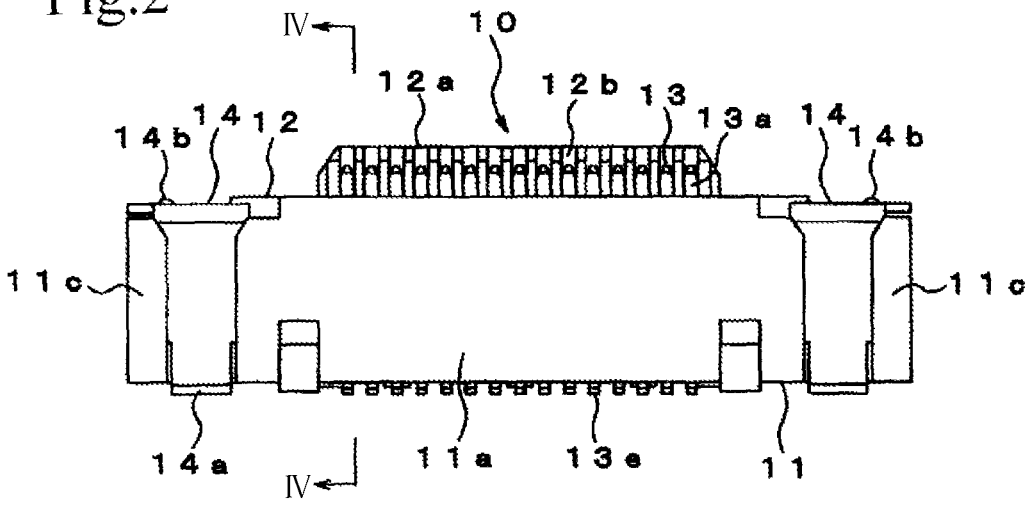
FIG. 2 is a front view showing the first connector.
Figure 3:
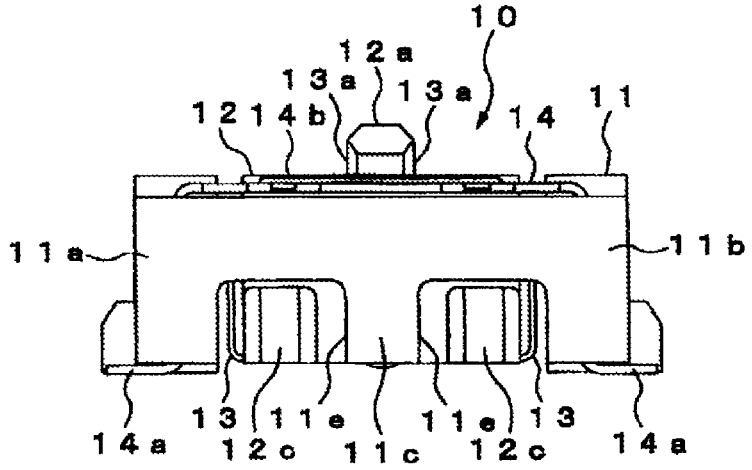
FIG. 3 is a side view showing the first connector.
Figure 4:
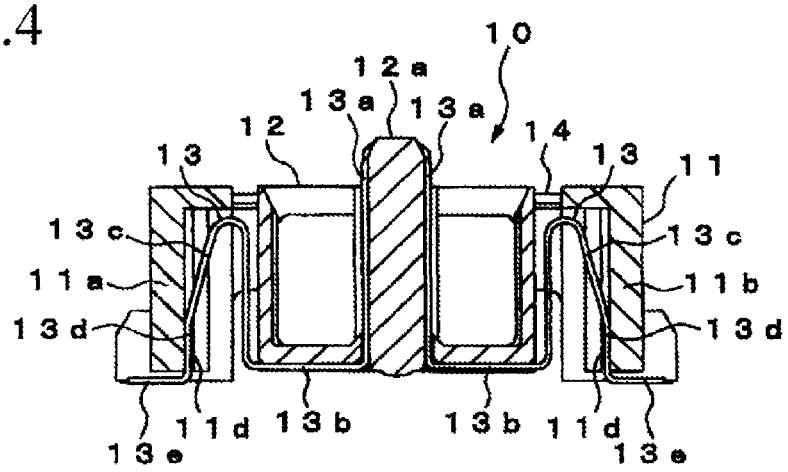
FIG. 4 is a cross-sectional view taken along a line IV-IV in FIG. 2.
Figure 5:
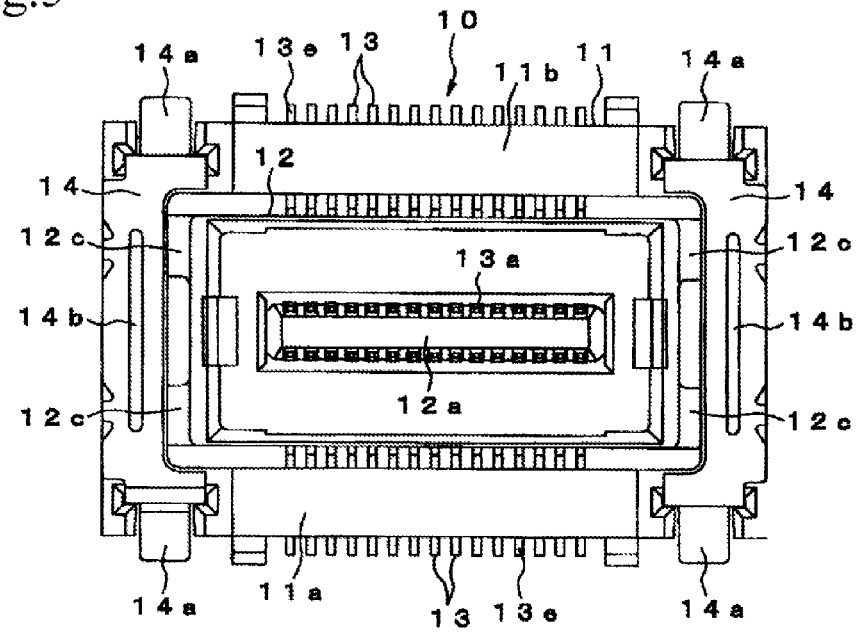
FIG. 5 is a plan view showing the first connector.
Figure 6:
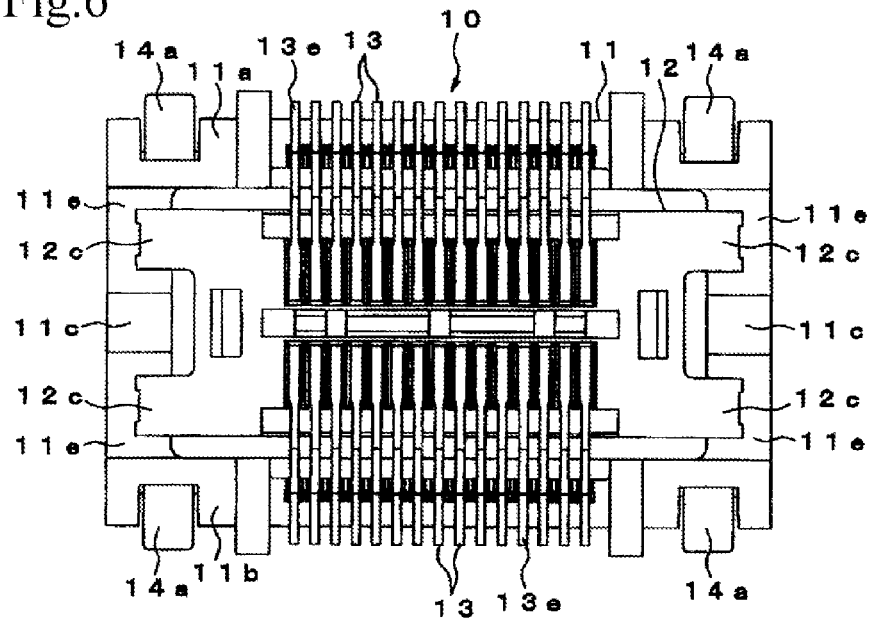
FIG. 6 is a bottom view showing the first connector.
Figure 7:
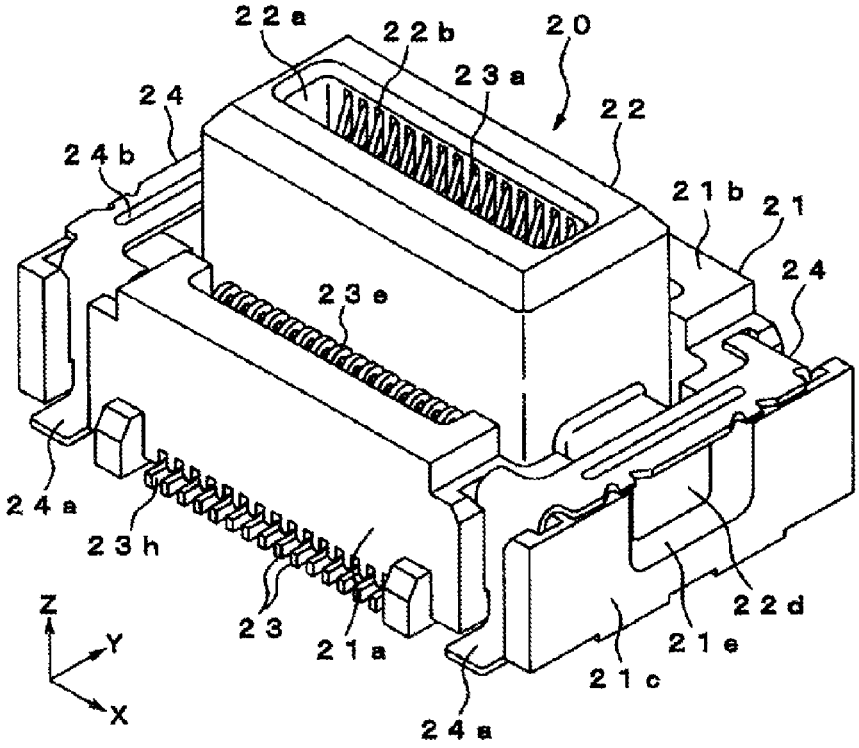
FIG. 7 is a perspective view showing a second connector.
Figure 8:
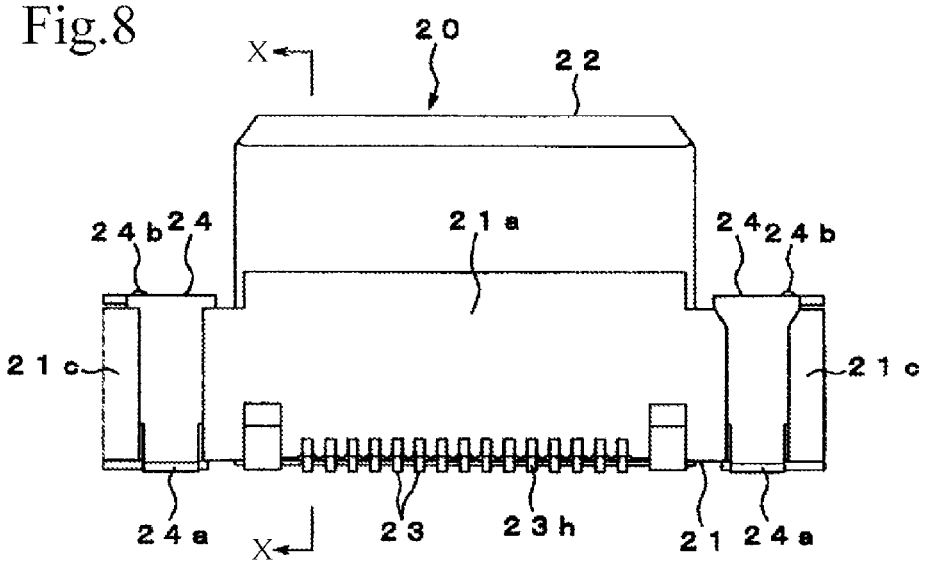
FIG. 8 is a front view showing the second connector.
Figure 9:
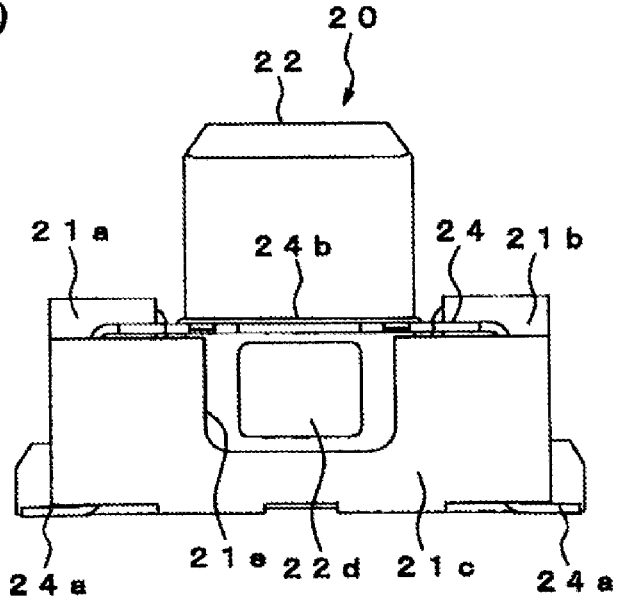
FIG. 9 is a side view showing the second connector.
Figure 10:
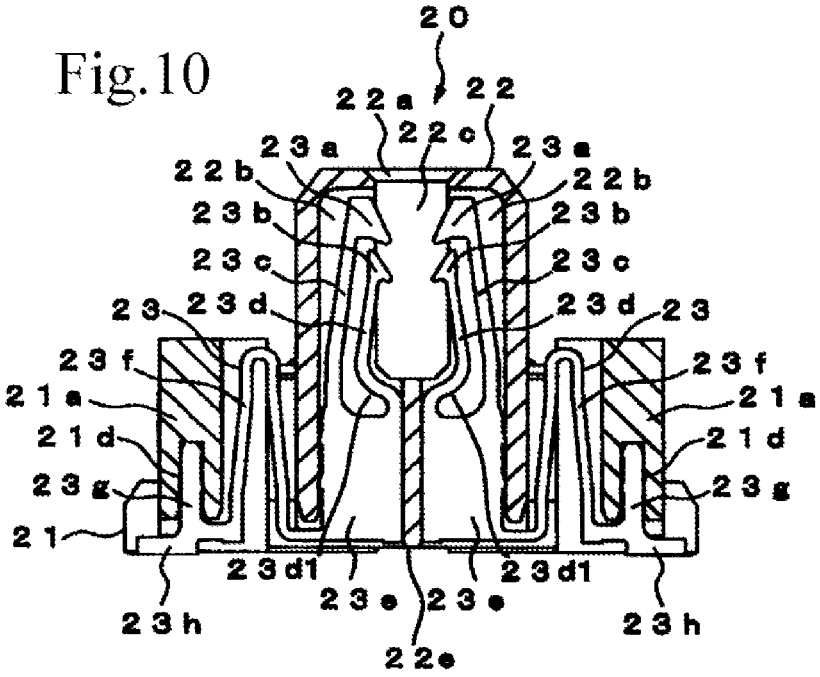
FIG. 10 is a cross-sectional view taken along a line X-X in FIG. 8.
Figure 11:
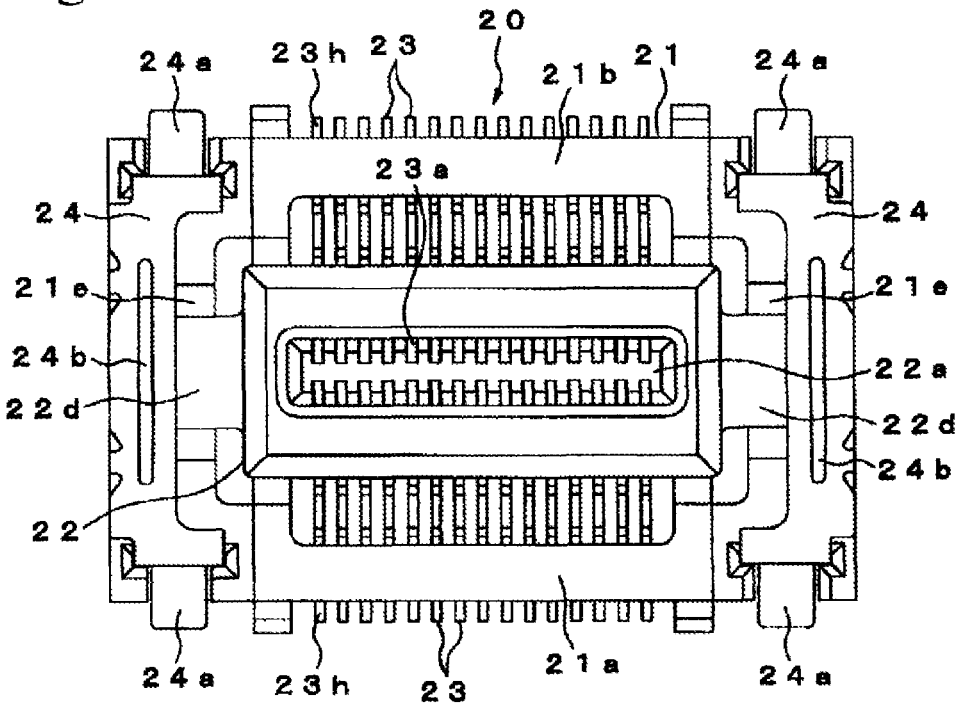
FIG. 11 is a plan view showing the second connector.
Figure 12:
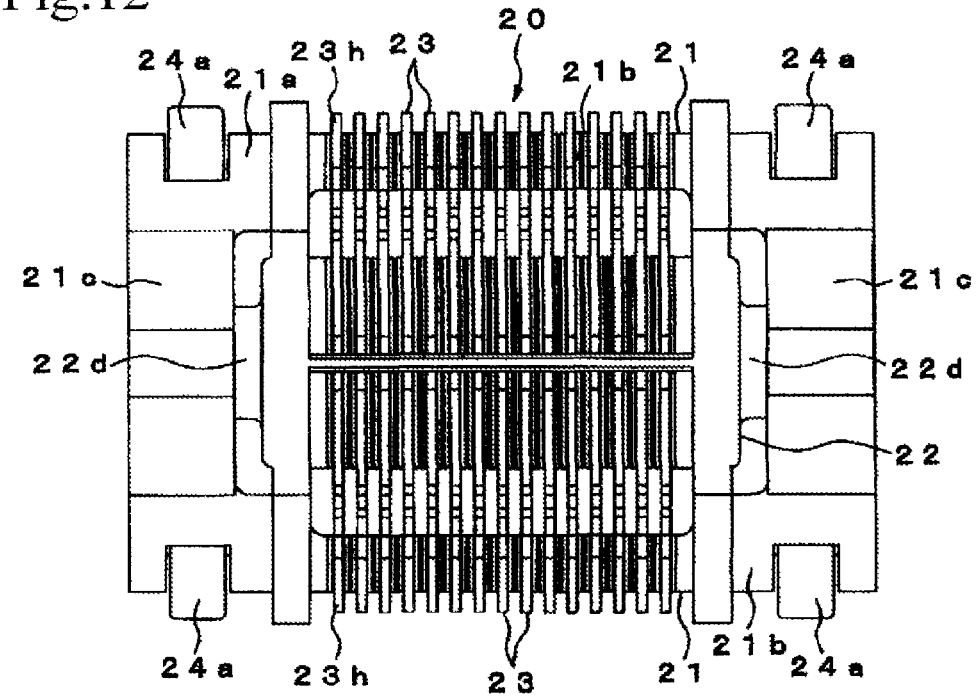
FIG. 12 is a bottom view showing the second connector.

FIG. 1 through FIG. 16 illustrate a connector unit according to an embodiment of the present invention, used for connecting, for example, a pair of printed substrates to each other. In the drawings, X-direction represents a width direction of the connector, Y-direction represents a front-back direction of the connector, and Z-direction represents an up-down direction of the connector.

The connector unit according to this embodiment includes a first connector 10 to be attached to a substrate 1 of the pair of substrates 1, 2 disposed such that respective surfaces oppose each other, and a second connector 20 to be attached to the other substrate 2.

Here, although the second connector 20 is turned upside down in FIG. 15 and FIG. 16 with respect to FIG. 7 to FIG. 12, the up-down direction referred to in the following description will be based on the up-down direction in FIG. 7 to FIG. 12.

Configuration of First Connector 10

The first connector 10 includes a first fixed housing 11 to be attached to the substrate 1, a first movable housing 12 disposed so as to move relative to the first fixed housing 11, a plurality of first terminals 13 retained by the first fixed housing 11 and the first movable housing 12, and a pair of first fixing members 14 for fixing the first fixed housing 11 to the substrate 1. The first terminals 13 are aligned at predetermined intervals in the width direction of the connector so as to form two rows, the two rows being aligned in the front-back direction of the connector.

The first fixed housing 11 is formed of a synthetic resin by molding, into a generally rectangular block shape smaller in height than in width and depth. The first fixed housing 11 includes a front face 11*a*, a rear face 11*b*, and a left and right lateral faces 11*c*, and the upper and the lower face are open upward and downward, respectively.

A plurality of fixing grooves 11*d* for fixing the respective first terminals 13 are provided on the inner side of the front face 11*a* and the rear face 11*b*, and the lateral faces 11*c* each include a pair of cutaway portions 11*e* of a generally rectangular shape that delimit the movement of the first movable housing 12 in the front-back direction, the cutaway portions 11*e* being aligned in the front-back direction.

The first movable housing 12 is formed of a synthetic resin by molding, into a generally rectangular block shape smaller in height than in width and depth. The first movable housing 12 is formed in a hollow shape having an opening oriented upward, and includes a projecting portion 12*a* erected upward from a central portion of the bottom face in the front-back direction.

The projecting portion 12*a* has a flat shape extending in the width direction of the first movable housing 12, and includes a plurality of holding grooves 12*b* formed on the front and rear faces, for holding the respective first terminals 13. When the first connector 10 and the second connector 20 are fitted together, the top portion of the projecting portion 12*a* is located close to a bottom portion of an insertion cavity 22*c* of a second movable housing 22 and a distal end portion of a second elastic portion 23*d* extending in a bent shape from a first fixing portion 23*e*.

The first movable housing 12 has an outer shape smaller than the inner shape of the first fixed housing 11, and disposed inside the first fixed housing 11 so as to move in the front-back direction and the width direction. In this embodiment, the top end of the first movable housing 12 is located at generally the same level as the uppermost end portion of the first fixed housing 11.

Further, first movable housing 12 includes a pair of projections 12*c* projecting in the width direction from each of the lateral faces, the projections 12*c* being aligned in the front-back direction. The projections 12*c* are each disposed in the corresponding cutaway portion 11*e* of the first fixed housing 11 so as to move in the front-back direction, the width direction, and the up-down direction. Here, a gap is provided between the bottom face of the first movable housing 12 and the substrate 1 as shown in FIG. 16, and the gap serves as a moving margin that allows the first movable housing 12 to move downward (toward the substrate 1).

Figure 13:
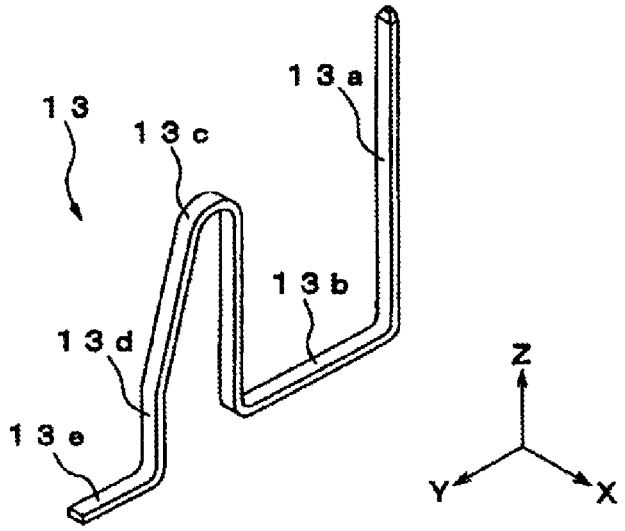
FIG. 13 is a perspective view showing a first terminal.

The first terminals 13 are formed by bending conductive metal plates, and made larger in the width direction (X-direction) than in the thickness direction (Y-direction or Z-direction), as shown in FIG. 13.

The first terminals 13 each include a contact portion 13*a* to be brought into contact with a terminal of the second connector 20, a first fixing portion 13*b* fixed to the first movable housing 12, a movable portion 13*c* elastically deformable in the front-back direction of the connector, a second fixing portion 13*d* fixed to the first fixed housing 11, and a substrate connection portion 13*e* to be connected to the substrate 1.

The contact portion 13*a* linearly extends in the up-down direction, and is retained by the holding groove 12*c* of the first movable housing 12.

The first fixing portion 13*b* extends in the front-back direction from the lower end portion of the contact portion 13*a*, and is fixed to the lower face of the first movable housing 12.

The movable portion 13*c* extends upward from the first fixing portion 13*b* along the outer face of the first movable housing 12, and is bent in an inverted U-shape in the vicinity of the upper end portion of the first movable housing 12 so as to extend downward. Accordingly, the movable portion 13*c* is elastically deformable in the front-back direction (Y-direction) of the connector, about the bent portion.

The second fixing portion 13*d* extends downward as further extension of the movable portion 13*c*, and is fixed to the fixing groove 11*d* of the first fixed housing 11.

The substrate connection portion 13*e* extends in the front-back direction from the lower end portion of the second fixing portion 13*d*, and sticks out of the first fixed housing 11 from the lower end portion of the front face 11*a* or rear face 11*b* of the first fixed housing 11.

Thus, the portion of the first terminal 13 on the side of the first fixing portion 13*b* and the portion thereof on the side of the second fixing portion 13*d* are located with a spacing therebetween in the front-back direction of the connector, and the movable portion 13*c* is provided between the first fixing portion 13*b* and the second fixing portion 13*d*.

The first fixing members 14 are formed by bending a metal plate, and located on the respective sides of the first fixed housing 11 in the width direction. The first fixing members 14 are each formed in a generally channel shape so as to extend along the upper face of the corresponding lateral face 11*c* of the first fixed housing 11 toward the front and rear faces, and the front and rear end portions of the first fixing member 14 are respectively fixed to the front face and the rear face of the lateral face 11*c*. The first fixing members 14 each include a pair of fixing portions 14*a*, via which the first fixing member 14 is soldered to the substrate 1, formed so as to respectively extend in the front-back direction from the front and rear end portions. The first fixing member 14 also includes a rib portion 14*b* formed on the upper face so as to extend in the front-back direction.

Configuration of Second Connector 20

The second connector 20 includes a second fixed housing 21 to be attached to the substrate 2, the second movable housing 22 disposed so as to move relative to the second fixed housing 21, a plurality of second terminals 23 retained by the second fixed housing 21 and the second movable housing 22, and a pair of second fixing members 24 for fixing the second fixed housing 21 to the substrate 2, and the second terminals 23 are aligned at predetermined intervals in the width direction of the connector so as to form two rows, the two rows being aligned in the front-back direction of the connector.

The second fixed housing 21 is formed of a synthetic resin by molding, into a generally rectangular block shape smaller in height than in width and depth. The second fixed housing 21 includes a front face 21*a*, a rear face 21*b*, and a left and right lateral faces 21*c*, and the upper and the lower face are open upward and downward, respectively. A plurality of fixing holes 21*d* for fixing the respective second terminals 23 are provided on the lower end portion of the front face 21*a* and the rear face 21*b*, and the lateral faces 21*c* each include a cutaway portion 21*e* of a generally rectangular shape that delimits the movement of the second movable housing 22 in the front-back direction.

The second movable housing 22 is formed of a synthetic resin by molding, into a generally rectangular block shape larger in height than in width and depth.

The second movable housing 22 includes an insertion port 22*a* formed on the upper face, for the projecting portion 12*a* of the first movable housing 12 to be inserted therethrough, the insertion port 22*a* having a slender shape extending in the width direction of the first movable housing 12.

A plurality of terminal slots 22*b* in which the second terminals 23 are respectively accommodated are provided in the second movable housing 22. The terminal slots 22*b* are aligned at predetermined intervals in the width direction of the connector so as to form two rows, the two rows being aligned in the front-back direction of the connector. The upper portion of each of the terminal slots 22*b* is open toward a central portion of the inner space of the second movable housing 22 in the front-back direction, and the insertion cavity 22*c*, into which the projecting portion 12*a* of the first movable housing 12 is inserted through the insertion port 22*a*, is formed between the front row and the rear row of the terminal slots 22*b*. The second terminals 23 are each fixed to the lower portion of the corresponding terminal slot 22*b*, and the lower end portion of each of the terminal slots 22*b* is open downward.

The second movable housing 22 has an outer shape smaller than the inner shape of the second fixed housing 21, and disposed inside the second fixed housing 21 so as to move in the front-back direction and the width direction. In this embodiment, the second movable housing 22 sticks out upward from the uppermost end portion of the second fixed housing 21, by approximately half of the height of the second movable housing 22. In addition, the second movable housing 22 includes a projection 22*c* projecting in the width direction from each of the lateral faces. The projection 12*c* is disposed in the cutaway portion 21*e* of the second fixed housing 21 so as to move in the front-back direction, the width direction, and the up-down direction.

Figure 14:
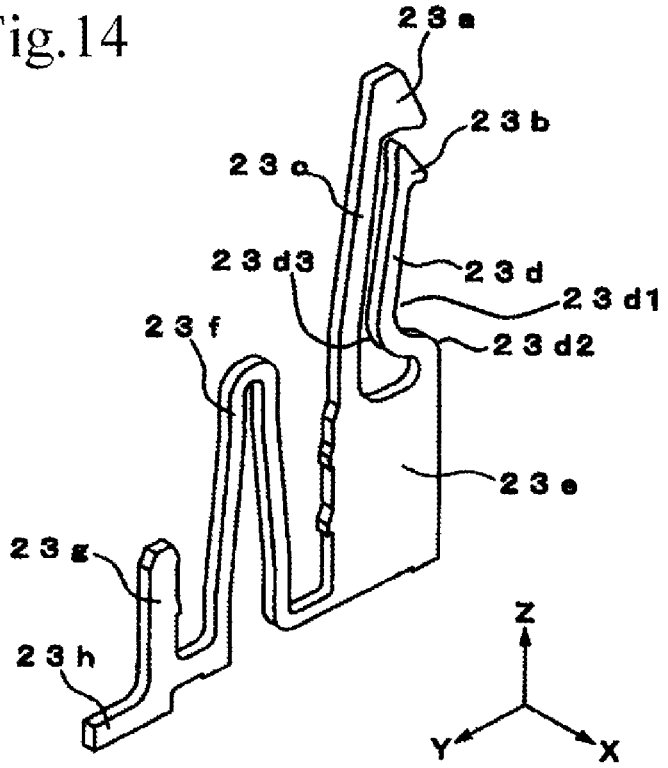
FIG. 14 is a perspective view showing a second terminal.

The second terminals 23 are each formed by punching a conductive metal plate, into a shape larger in the thickness direction (Y-direction or Z-direction) than in the width (X-direction), as shown in FIG. 14.

The second terminals 23 each include a first contact portion 23*a* and a second contact portion 23*b* to be brought into contact with the first terminal 13 of the first connector 10, a first elastic portion 23*c* and the second elastic portion 23*d* elastically deformable in the direction for contacting the first terminal 13, the first fixing portion 23*e* fixed to the second movable housing 22, a movable portion 23*f* elastically deformable in the width direction of the connector, a second fixing portion 23*g* fixed to the second fixed housing 21, and a substrate connection portion 23*h* to be connected to the substrate 2.

The first contact portion 23*a* and the second contact portion 23*b* have a generally triangular shape, and each project into the insertion cavity 22*c* from an upper portion of the terminal slot 22*b*. In this embodiment, the contact portions 23*a*, 23*b* are located with a spacing therebetween in the up-down direction, the first contact portion 23*a* being located on the upper side of the second contact portion 23*b*.

Because of the mentioned configuration, the second terminal 23 contacts the first terminal 13 via the first and second contact portions 23*a*, 23*b*, and hence exerts a larger contact force on the first terminal 13 to firmly hold the same, compared with the case of contacting via a single contact portion. Therefore, even though the first connector 10 and the second connector 20 fitted together are subjected to vibration during the practical use, the first and second contact portions 23*a*, 23*b* can be prevented from micro-sliding relative to the first terminal 13 and from thus scraping off the plating and increasing the contact resistance. Consequently, the connection reliability of the connectors can be upgraded.

The first elastic portion 23*c* extends upward from the upper end portion of the first fixing portion 23*e*, and the first contact portion 23*a* is formed on the distal end portion of the first elastic portion 23*c*.

The second elastic portion 23*d* extends upward from the upper end portion of the first fixing portion 23*e*, and the second contact portion 23*b* is formed on the distal end portion of the second elastic portion 23*d*. In this embodiment, the elastic portions 23*c*, 23*d* are located with a spacing therebetween in the front-back direction, the second elastic portion 23*d* being located closer to the center of the insertion cavity 22*c* in the front-back direction.

The second elastic portion 23*d* includes a bent section 23*d*1 formed close to the proximal end portion thereof connected to the first fixing portion 23*e*, so as to circumvent along the shape of the distal end portion and a part of the lateral portion of the projecting portion 12*a* of the first movable housing 12. The bent section 23*d*1 is connected via the proximal end portion to the first fixing portion 23*e* at the position where the bent section contacts a central partition wall 22*e* of the second movable housing 22 provided between the front row and the rear row of the second terminals 23. The second elastic portion 23*d* includes further includes an outward curved portion 23*d*2 bent forward or backward away from the central partition wall 22*e* and an inward curved portion 23*d*3 again curved toward the center of the insertion cavity 22*c* in the front-back direction.

In the case where the second elastic portion 23*d* is formed in a linear shape, the proximal end portion connected to the first fixing portion 23*e* has to be shifted forward or backward away from the central partition wall 22*e* in order to avoid interference with the projecting portion 12*a* of the first movable housing 12, and hence the size of the second movable housing 22 in the front-back direction has to be increased. Therefore, not only the second connector 20 but also the first connector 10 have to be made larger in the front-back direction. In contrast, forming the second elastic portion 23*d* with the bent section 23*d*1 configured as above allows the interference to be avoided thereby enabling reduction in size of the connectors. In addition, the bent section 23*d*1 serves to increase the spring length of the second elastic portion 23*d*, thereby preventing degradation in insertion and removal performance and in spring elasticity, and decline in connection reliability of the connectors.

The first fixing portion 23*e* extends downward from the proximal end portion of the elastic portions 23*c*, 23*d*, and is fixed to the lower end portion of the terminal slot 22*b*.

The movable portion 23*f* extends upward from the lower end portion of the first fixing portion 23*e* along the outer face of the second movable housing 22, and then extends downward in an inverted U-shape from a generally central position of the second movable housing 22 in the up-down direction, so as to be elastically deformed in the width direction (X-direction) of the connector, about the top end of the inverted U-shape.

The second fixing portion 23*g* extends upward as further extension of the movable portion 23*f*, and is fixed in the fixing hole 21*d* of the second fixed housing 21.

The substrate connection portion 23*h* extends in the front-back direction from the lower end portion of the second fixing portion 23*g*, and sticks out of the second fixed housing 21 from the lower end portion of the front face 21*a* or rear face 21*b* of the second fixed housing 21.

Thus, the portion of the second terminal 23 on the side of the first fixing portion 23*e* and the portion thereof on the side of the second fixing portion 23*g* are located with a spacing therebetween in the front-back direction of the connector, and the movable portion 23*f* is provided between the first fixing portion 23*e* and the second fixing portion 23*g*.

The second fixing members 24 are formed by bending a metal plate, and located on the respective sides of the second fixed housing 21 in the width direction. The second fixing members 24 are each formed in a generally channel shape so as to extend along the upper face of the corresponding lateral face 21*c* of the second fixed housing 21 toward the front and rear faces, and the front and rear end portions of the second fixing member 24 are respectively fixed to the front face and the rear face of the lateral face 21*c*. The second fixing members 24 each include a pair of fixing portions 24*a*, via which the second fixing member 24 is soldered to the substrate 2, formed so as to extend in the front-back direction. The second fixing member 24 also includes a rib portion 24*b* formed on the upper face so as to extend in the front-back direction.

Mounting on Substrate

With the connectors configured as above, the first fixed housing 11 of the first connector 10 is fixed to the substrate 1, by soldering the fixing portions 14*a* of the respective first fixing members 14 and the substrate connection portions 13*e* of the respective first terminals 13 of the first connector 10 to the substrate 1. Likewise, the second fixed housing 21 of the second connector 20 is fixed to the substrate 2, by soldering the fixing portions 24*a* of the respective second fixing members 24 and the substrate connection portions 23*h* of the respective second terminals 23 of the second connector 20 to the substrate 2.

Connection and Working of Connectors

Figure 15:
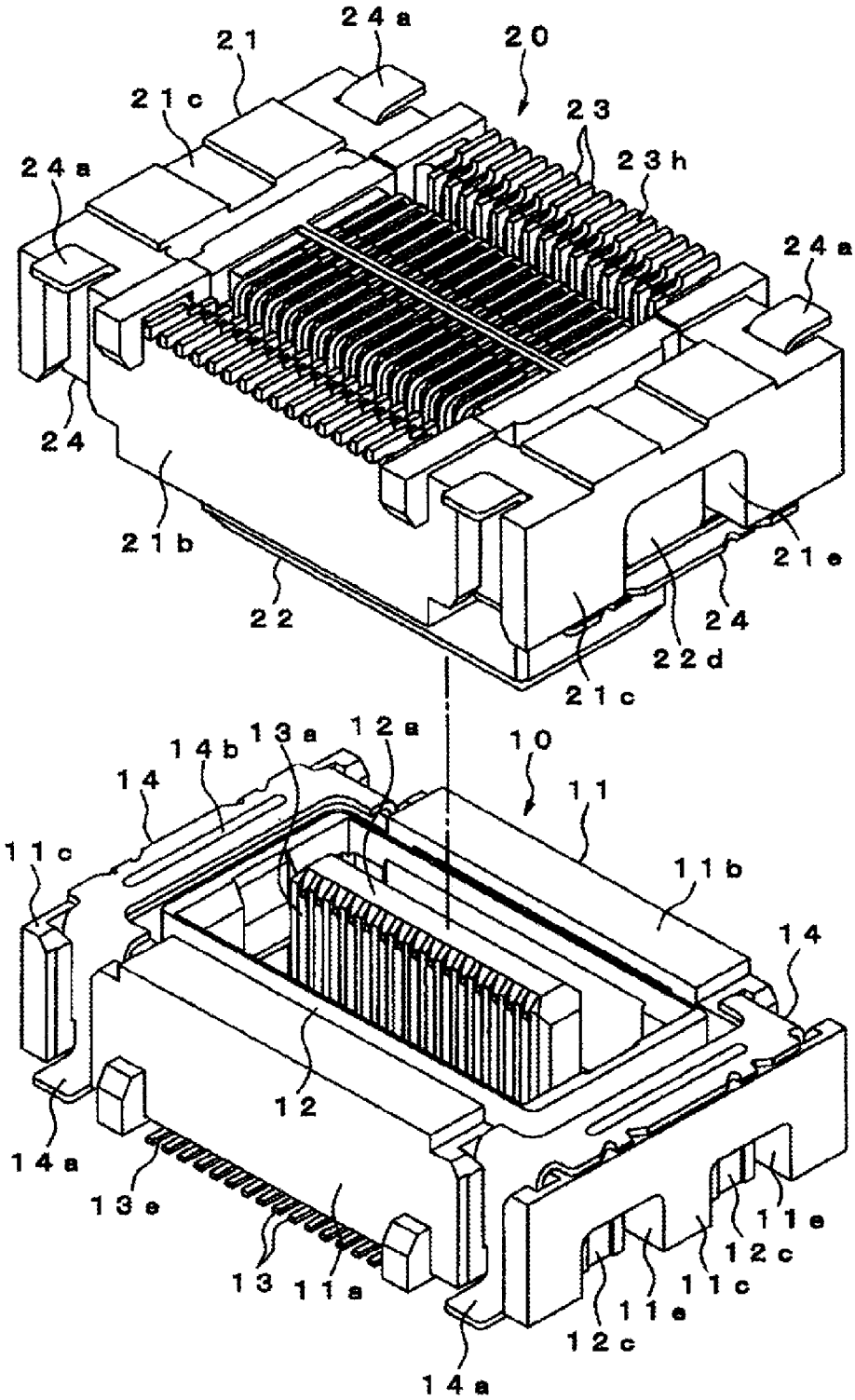
FIG. 15 is a perspective view for explaining a connection process of a connector unit.
Figure 16:
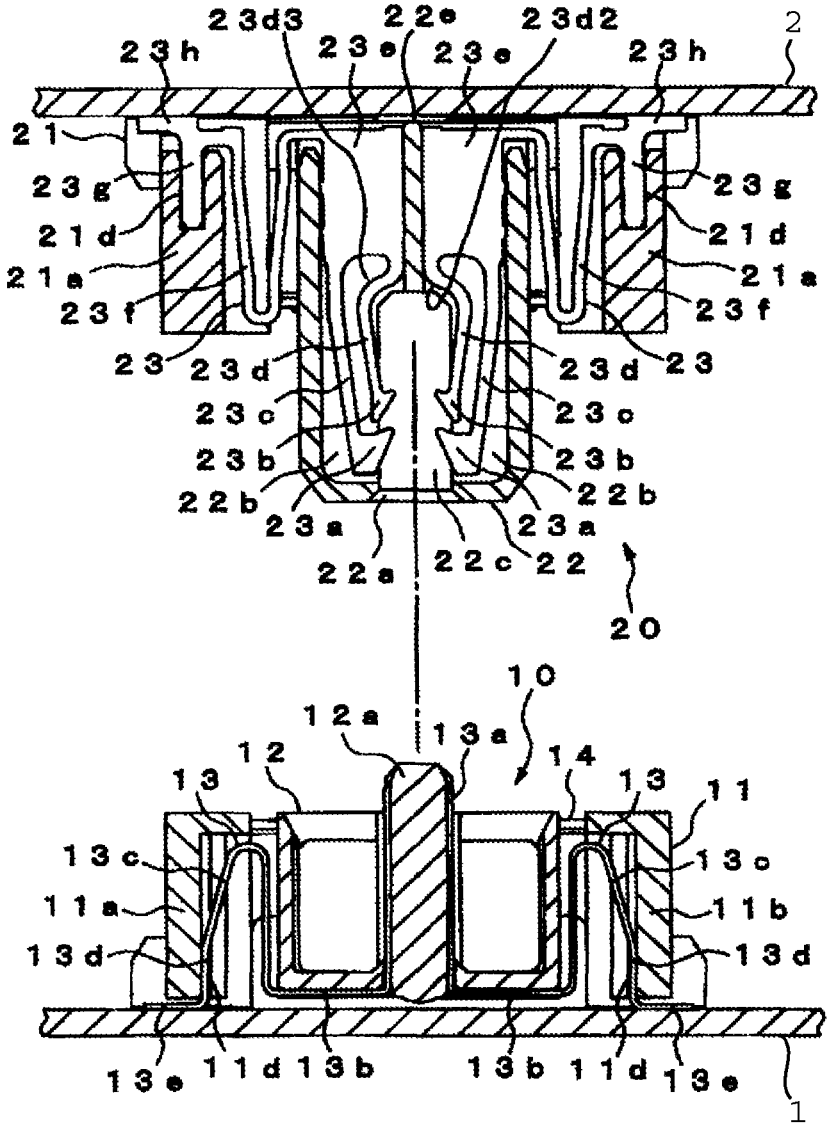
FIG. 16 is a side cross-sectional view for explaining the connection process of the connector unit.

To connect the first connector 10 and the second connector 20 to each other, the second connector 20 and the substrate 2 are turned upside down as shown in FIG. 15 and FIG. 16, and the first movable housing 12 of the first connector 10 and the second movable housing 22 of the second connector 20 are fitted to each other.

Upon doing so, the second movable housing 22 is inserted in the first movable housing 12, and the projecting portion 12*a* of the first movable housing 12 is inserted in the insertion cavity 22*c* of the second movable housing 22 through the insertion port 22*a* thereof. Accordingly, the contact portions 13*a* of the respective first terminals 13 are press-inserted into between the front row and the rear row of the first and second contact portions 23*a*, 23*b* of the second terminal 23, and the contact portions 13*a* of the first terminal 13 and the first and second contact portions 23*a*, 23*b* of the second terminals 23 are respectively brought into contact with each other, so that the first terminals 13 and the second terminals 23 are respectively connected to each other.

In this process, the second contact portion 23*b* of the second terminal 23 makes contact with the contact portion 13*a* of the first terminal 13 following first contact portion 23*a* of the second terminal 23, and therefore even though a foreign matter such as dust or stain is stuck to the contact portion 13*a* of the first terminal 13, the second contact portion 23*b* can make contact therewith after the foreign matter is removed by the first contact portion 23*a*.

In the case where the substrates 1 and 2 are positionally shifted relative to each other in the front-back direction (Y-direction) or the up-down direction (Z-direction) of the connector after the connection is completed, the first movable housing 12 of the first connector 10 is displaced in the front-back direction (Y-direction) or the up-down direction (Z-direction) of the connector relative to the first fixed housing 11, to thereby absorb the positional shift between the substrates 1 and 2 in the front-back direction or the up-down direction of the connector.

In the case where the substrates 1 and 2 are positionally shifted relative to each other in the width direction (X-direction) of the connector, the second movable housing 22 of the second connector 20 is displaced in the width direction (X-direction) of the connector relative to the second fixed housing 21, to thereby absorb the positional shift between the substrates 1 and 2 in the width direction of the connector.

The mentioned working is realized because the movable portion 13*c* of the first terminal 13 of the first connector 10 is larger in the width direction (X-direction) than in the thickness direction (Y-direction or Z-direction), and can hence be elastically deformed easily in the front-back direction (Y-direction) or the up-down direction (Z-direction) of the connector.

Likewise, the movable portion 23*f* of the second terminal 23 of the second connector 20 is larger in the thickness direction (Y-direction or Z-direction) than in the width direction (X-direction), and can hence be elastically deformed easily in the width direction (X-direction) of the connector.

Accordingly, when the positional shift between the substrates 1 and 2 takes place in the front-back direction (Y-direction) of the connector, the movable portion 13*c* of the first terminal 13 is elastically deform by a larger amount than the movable portion 23*f* of the second terminal 23, and when the positional shift between the substrates 1 and 2 takes place in the width direction (X-direction) of the connector the movable portion 23*f* of the second terminal 23 is elastically deform by a larger amount than the movable portion 13*c* of the first terminal 13.

In addition, since the movable portion 13*c* of the first terminal 13 is located between the portion of the first terminal 13 on the side of the first fixing portion 13*b* and the portion thereof on the side of the second fixing portion 13*d*, and the mentioned portions of the first terminal 13 are spaced from each other in the front-back direction of the connector, making the movable portion 13*c* of the first terminal 13 in a vertically elongate shape in the up-down direction does not lead to an increase in size of the first terminal 13 in the up-down direction.

Likewise, since the movable portion 23*f* of the second terminal 23 is located between the portion of the second terminal 23 on the side of the first fixing portion 23*e* and the portion thereof on the side of the second fixing portion 23*g*, and the mentioned portions of the second terminal 23 are spaced from each other in the front-back direction of the connector, making the movable portion 23*f* of the second terminal 23 in a vertically elongate shape does not lead to an increase in size of the second terminal 23 in the up-down direction.

ADVANTAGEOUS EFFECTS OF EMBODIMENT

According to this embodiment, as described thus far, the movable portion 13*c* of the first terminal 13 of the first connector 10 is formed to be larger in the width direction than in the thickness direction, so as to be elastically deformed in the front-back direction (Y-direction) of the connector, and the movable portion 23*f* of the second terminal 23 of the second connector 20 is formed to be larger in the thickness direction than in the width direction, so as to be elastically deformed in the width direction (X-direction) of the connector. Therefore, the movable portions 13*c*, 23*f* can be formed with an increased cross-sectional area, thereby enabling the allowable current of the terminals 13, 23 to be increased, unlike a configuration in which the movable portion is elastically deformable to a sufficient extent both in the front-back direction and in the width direction of the connector.

Consequently, the connectors configured as above enable the allowable current of the terminal to be increased, despite the connectors being configured to move relative to each other in the front-back direction and the width direction thereof, and are therefore applicable to large-current devices. Naturally, the connectors may be applied to various purposes other than for the large-current devices.

In the foregoing connectors, since the portion of the first terminal 13 on the side of the first fixing portion 13*b* and the portion thereof on the side of the second fixing portion 13*d* are spaced from each other in the front-back direction of the connector, and the movable portion 13*c* of the first terminal 13 is located between those portions, the movable portion 13*c* can be formed in a vertically elongate shape without incurring an increase in size of the first terminal 13 in the up-down direction.

Likewise, since the portion of the second terminal 23 on the side of the first fixing portion 23*e* and the portion thereof on the side of the second fixing portion 23*g* are spaced from each other in the front-back direction of the connector, and the movable portion 23*f* of the second terminal 23 is located between those portions, the movable portion 23*f* can be formed in a vertically elongate shape without incurring an increase in size of the second terminal 23 in the up-down direction.

The mentioned configuration enables the displacement ranges of the first and second movable housings 12, 22 to be increased without incurring an increase in size of the first and second connectors 10, 20 in the up-down direction, thereby allowing the first and second connectors 10, 20 to be advantageously applied to the substrates 1 and 2 disposed with a narrow clearance or disposed so as to make a large positional shift therebetween.

In addition, since the movable portion 13*c* of the first terminal 13 is bent in the up-down direction, the movable portion 13*c* can be flexurally deformed about the bent position in the thickness direction, in which the movable portion 13*c* is smaller than in the width direction, and therefore the first terminal 13 can be elastically deformed easily.

Likewise, the movable portion 23*f* of the second terminal 23 is bent in the up-down direction, the movable portion 23*f* can be flexurally deformed about the bent position in the width direction, in which the movable portion 23*f* is smaller than in the thickness direction, and therefore the second terminal 23 can be elastically deformed easily.

Further, the first terminal 13 includes the contact portion 13*a* to be brought into contact with the second terminal 23, and the second terminal 23 includes the elastically deformable first and second contact portions 23*a*, 23*b* to be brought into contact with the contact portion 13*a* of the first terminal 13, the first and second contact portions 23*a*, 23*b* being disposed with a spacing therebetween in the direction in which the first and second connectors 10, 20 are fitted together. Therefore, even though a foreign matter such as dust or stain is stuck to the contact portion 13*a* of the first terminal 13, the second contact portion 23*b* can make contact therewith after the foreign matter is removed by the first contact portion 23*a*, which assures the electrical conduction between the first terminal 13 and the second terminal 23.

Although the counterpart of the first connector 10 is exemplified by the multi-contact second connector 20 including the plurality of elastic portions and contact portions in the foregoing embodiment, the first connector 10 may also be connected to a single-contact connector including only one each of the elastic portion and the contact portion.

Although the counterpart of the first connector 10 is exemplified by the second connector 20 including the movable portion 23 in the foregoing embodiment, the first connector 10 may also be connected to a connector without a floating function in which the movable portion 23 is not included and the fixed housing 21 and the movable housing 22 are not distinctively provided. Likewise, although the counterpart of the second connector 20 is exemplified by the first connector 10 including the movable portion 13, the second connector 20 may also be connected to a connector without a floating function in which the movable portion 13 is not included and the fixed housing 11 and the movable housing 12 are not distinctively provided.

Further, although the connectors 10, 20 are configured on the premise that the substrates 1, 2 are opposed to each other in the up-down direction in the foregoing embodiment, in the case where the substrates are opposed in directions other than the up-down direction, the specified direction in which the substrates are opposed corresponds to the up-down direction in the present invention.

What is claimed is:

1. A connector comprising:

a housing; and a terminal including a first contact portion and a second contact portion to be brought into contact with a mating terminal of a mating connector, a first elastic portion and a second elastic portion elastically deformable in a direction to contact the mating terminal, and a first fixing portion fixed to the housing, wherein the housing includes a central partition wall formed at a central portion of the connector in a front-back direction and extending in the direction to contact the mating terminal, so as to oppose a projecting portion of a housing of the mating connector and to retain the mating terminal when the connectors are fitted together, the terminal is disposed such that the first fixing portion contacts the central partition wall, the first and the second elastic portions are formed so as to extend upward from an upper end portion of the first fixing portion and spaced from each other in the front-back direction with the second elastic portion located closer to the central portion in the front-back direction than the first elastic portion, and the second elastic portion includes a bent section formed close to a proximal end portion connected to the first fixing portion, so as to circumvent along a shape of a distal end portion and a part of a lateral portion of the projecting portion of the mating connector.

2. The connector according to claim 1, wherein the bent section is connected via a proximal end portion to the first fixing portion at a position where the bent section contacts the central partition wall, and is bent away from the central partition wall and then curved toward the central portion in the front-back direction.

* * * * *